United States Patent [19]

Vidal

[11] Patent Number: 4,671,976

[45] Date of Patent: Jun. 9, 1987

[54] WEB-TYPE STOCK MATERIAL WITH UPWARDLY PROJECTING FILAMENTARY ELEMENTS AND DEFINED PERIPHERY

[76] Inventor: Stella M. Vidal, 21 E. 22nd St., 6H, New York, N.Y. 10010

[21] Appl. No.: 896,464

[22] Filed: Aug. 13, 1986

Related U.S. Application Data

[63] Continuation-in-part of Ser. No. 793,677, Oct. 31, 1985, abandoned, which is a continuation of Ser. No. 587,888, Mar. 9, 1984, abandoned, which is a continuation of Ser. No. 296,294, Aug. 26, 1981, abandoned.

[51] Int. Cl.[4] ..... A47K 1/14; E03C 1/26; E03C 1/264

[52] U.S. Cl. ..... 428/40; 4/286; 4/292; 4/293; 428/65; 428/66; 428/85; 428/89; 428/92; 428/95

[58] Field of Search ..... 4/286, 292, 293; 428/40, 92, 65, 66, 85, 89, 343, 95

[56] References Cited

U.S. PATENT DOCUMENTS

| | | | |
|---|---|---|---|
| 333,935 | 1/1886 | Ducan | 4/292 |
| 950,574 | 3/1910 | Morgan | 4/292 |
| 1,292,856 | 1/1919 | Niblo | 4/287 |
| 1,886,676 | 11/1932 | Heuacker | 4/292 |
| 1,935,128 | 11/1933 | Pullman | 4/286 |
| 2,233,234 | 2/1941 | Wilson | 4/291 |
| 2,447,178 | 8/1948 | Hatchette | 210/499 |
| 2,506,669 | 5/1950 | Heuacker | 4/292 |
| 2,690,569 | 10/1954 | Kozerski | 4/292 |
| 3,268,920 | 8/1966 | Beer | 4/292 |
| 3,788,485 | 1/1974 | Bruning | 4/286 |
| 3,935,602 | 2/1976 | Kale | 4/292 |
| 4,418,432 | 12/1983 | Vidal | 428/65 |

*Primary Examiner*—Marion C. McCamish
*Attorney, Agent, or Firm*—Cooper, Dunham, Griffin & Moran

[57] ABSTRACT

Web-type stock material having upwardly projecting filamentary elements and a defined periphery, comprising, in combination, a flexible base member for overlying a floor surface in immediately surrounding relation to a liquid egress opening in the surface, the base member having a central hole for register with the egress opening; and a three-dimensional mat carried by the base member and comprising filamentary elements distributed throughout a volume extending horizontally at least over the entire area of the hole and vertically upwardly above the base member to a locality spaced above the base member for engaging and arresting liquid-carried debris such as hair outside and above the egress opening while permitting flow of liquid downwardly into the egress opening. Some at least of the filamentary elements extend transversely across the hole and intersect with each other at a multiplicity of points distributed substantially uniformly over the entire area of the hole so as to subdivide the hole into a multiplicity of individually small openings for downward liquid flow into the egress opening, the transversely extending filamentary elements and the base member cooperatively constituting a web having a periphery defined by the base member; and the filamentary elements include a multiplicity of flexible elements projecting upwardly throughout the entire vertical extent of the aforesaid volume and distributed substantially uniformly at least over the entire area of the hole in closely adjacent relation to each other.

29 Claims, 19 Drawing Figures

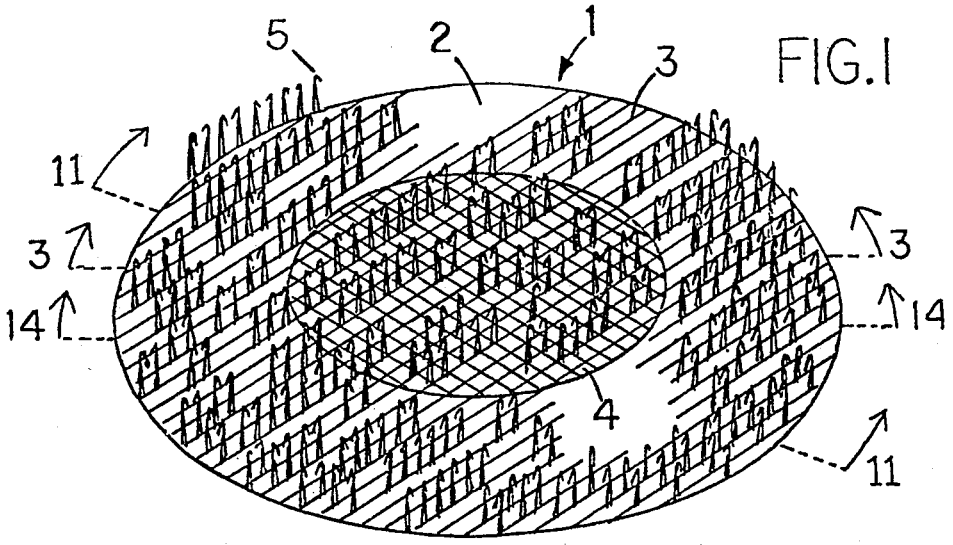
FIG. 1
FIG. 2
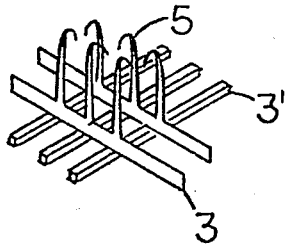
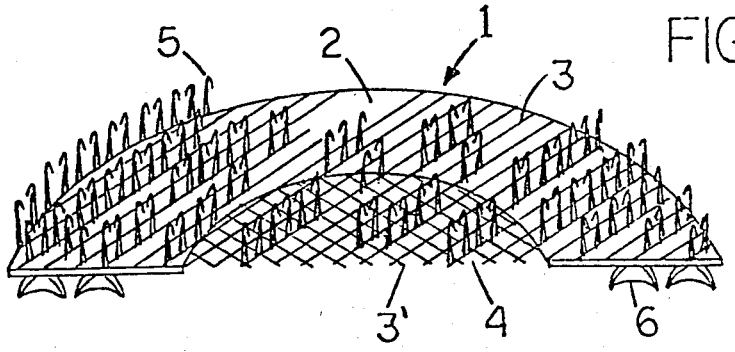
FIG. 3

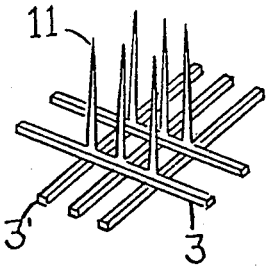
FIG.6
FIG.7
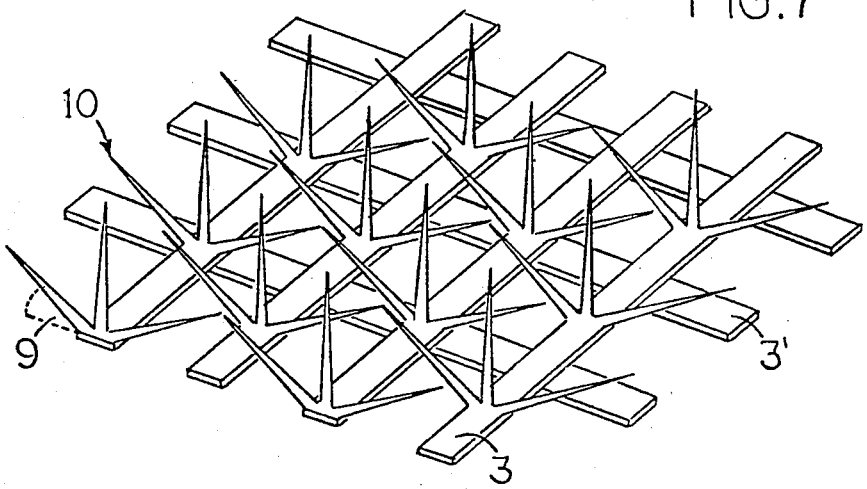
FIG.8
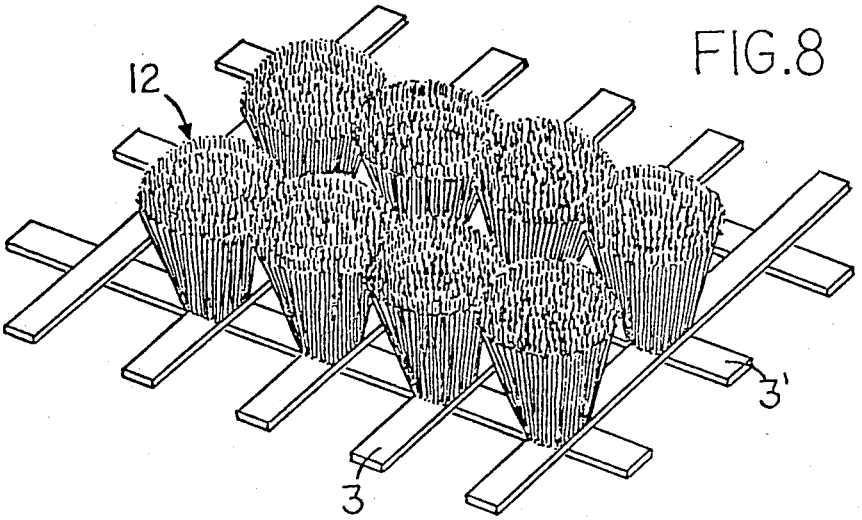

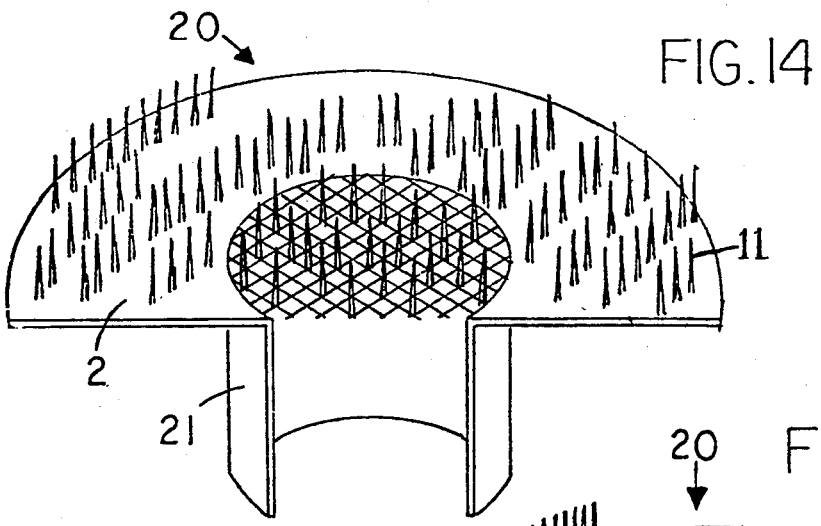
FIG. 14
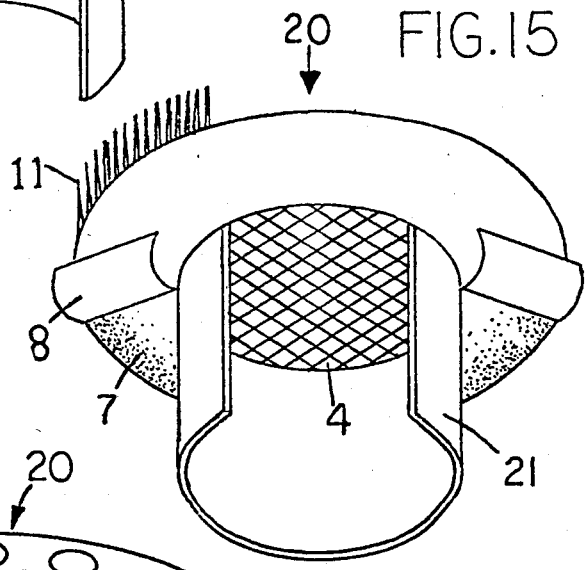
FIG. 15
FIG. 16
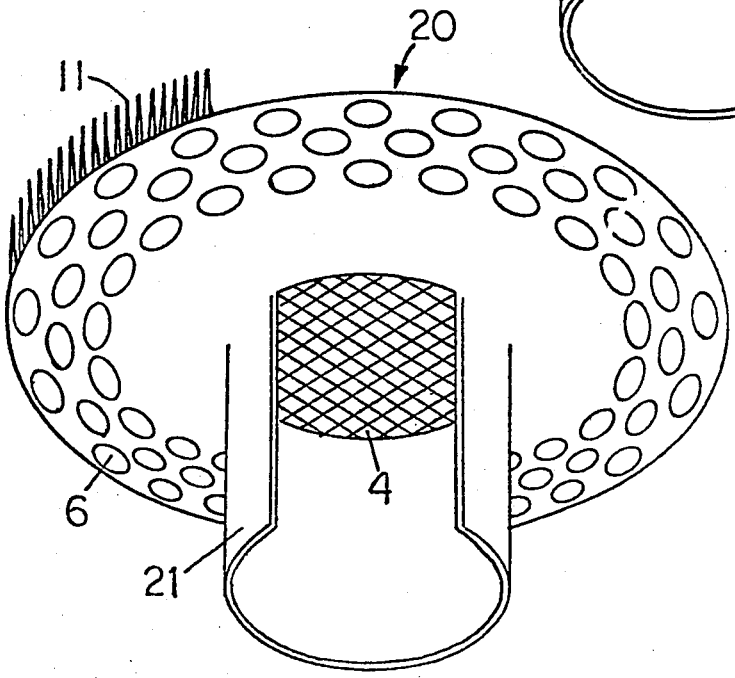

WEB-TYPE STOCK MATERIAL WITH UPWARDLY PROJECTING FILAMENTARY ELEMENTS AND DEFINED PERIPHERY

CROSS REFERENCE TO RELATED APPLICATIONS

This application is a continuation-in-part of applicant's copending U.S. patent application Ser. No. 793,677, filed Oct. 31, 1985, now abandoned, which was a continuation of applicant's U.S. patent application Ser. No. 587,888, filed Mar. 9, 1984, now abandoned, which was a continuation of applicant's U.S. patent application Ser. No. 296,294, filed Aug. 26, 1981, now abandoned.

BACKGROUND OF THE INVENTION

This invention relates to stock material comprising a web from which extend a multiplicity of upwardly projecting filamentary elements, and having a defined periphery.

In one important specific sense, the invention is particularly directed to such stock material having utility as a fluid filter for the inlet opening of a drain or the like, e.g. (without limitation) a waste pipe in an outdoor yard or pavement, a roof drain or downspout, a floor drain, a drain in an industrial or chemical tank, or a swimming pool, basin, or tub drain, to prevent debris from entering the drain or clogging the drain inlet opening.

For purposes of illustration, the invention will be specifically described hereinbelow as embodied in devices for the prevention of clogging of drainpipes of bathtubs, shower stalls, lavatories and the like, particularly due to the accumulation of hair therein. The invention as thus embodied provides a new article which prevents hair, hairpins or any other object carried away with the water flow during the taking of showers or washings or the like, from entering and clogging the drainpipes of bathtubs, shower stalls, lavatories and the like, by means of an entangling action carried out by flexible spikes or bristles or by an open lofty integrated web of continuous crinkled filaments or by rough indented openings provided by the article, in conjunction with a blocking action carried out by the shape of the article which is shaped to be adapted to cover entirely the strainers, as well as the drain-pipe opening of bathtubs, shower stalls, lavatories and the like, and both said actions being exerted upon the fallen hair, hairpins or any other object carried away with the water flow the the article is installed over a conventional strainer or over the drainpipe opening and inserted into it, thereby preventing said hair, hairpins or any other object from entering and clogging said drainpipes, while the net-like structure and/or the open web, which constitutes the body of the article, allows through suitably dimensioned openings, the free flow of running water into the drainpipe opening.

The main cause of clogging of drainpipes of bathtubs, shower stalls, lavatories and the like is the accumulation of hair therein. The clogging of drainpipes of bathtubs, shower stalls, lavatories and the like due to the accumulation of hair therein during the taking of showers or washings and the like, is a problem that has not yet been property solved by any of the usual ways of overcoming this problem which consist in using unclogging chemical products, which represent a health hazard in the home, or using a plunger or a drain auger, or a snake, or calling a plumber. The disadvantages of these approaches to the problem are that they do not prevent the clogging itself by eliminating its cause, which is the entrance of hair into said drainpipes, and only attempt to solve it after it has occurred, often even without good results and thus drainpipes are regularly clogged because of hair accumulation therein. Other disadvantages of the use of these apparent "solutions" are that they represent a nuisance, an additional expense and can be damaging to the piping system in the long run, and above all, clogging will keep recurring.

Heretofore, a major disadvantage of the existing strainers which claim to end the clogging problem of drainpipes of bathtubs, shower stalls, lavatories and the like, is that they do not actually prevent said fallen hair from entering and clogging the drainpipes because they do not exert a holding action upon the hair which slides into the openings of said strainers, thus entering and clogging the drainpipes during the taking of showers or washings, or the like. In addition, the existing drain covers provided with a screen which claim to prevent hair from clogging the drainpipes with the screen, actually prevent the free flow of draining water into the drainpipes due to the smallness of the openings of the screen, which intend to impede the passage of hair and foreign matter, thereby causing, during the taking of showers or washings, an accumulation of water on the bathtub and shower stall floor that with the addition of hair, dirt and high density suds, makes it all the more difficult for the water to drain, becoming stagnant, which is not uncomfortable when taking a shower and also requires repeated cleaning afterwards. A similar situation is encountered when shampooing one's hair on the lavatory, where there will be normally a substantial accumulation of both high density suds and hair and the small openings of the screen cause the stagnation of water that with the addition of the aforementioned hair and suds makes it all the more difficult for the water to drain, requiring also repeated cleanings afterwards. Furthermore, a disadvantage of the existing conventional vertically extensible drain stoppers, hereinafter called pop-up stoppers, or the like, of the drain control systems of bathtubs, lavatories and the like, in reference to this problem, is that they are not designed to prevent clogging due to the accumulation of hair into said drainpipes. Therefore, there is no device which actually ends the clogging problem of drainpipes in a satisfactory way, and this proves the need for new means of solving this problem.

The present invention provides the means to overcome the foregoing problem and to avoid the aforementioned disadvantages of the prior art, offering novel means for preventing hair from clogging the drainpipes of bathtubs, shower stalls, lavatories and the like, consisting of spikes, bristles, open web of crinkled filaments, or rough indented openings of the net-like structure, to exert an entangling and gripping action upon the fallen hair, hairpins or any other object during the taking of showers or washings or the like, thereby allowing the provision of large enough openings of the net-like structure, and/or of the open web, which constitutes the body of the article, in order to insure the free flow of running water without hair into the drainpipe opening.

SUMMARY OF THE INVENTION

The present invention broadly contemplates the provision of stock material comprising a web with filamentary material extending upwardly from the web surface to constitute a pile, and web having a meshlike central portion through which liquid can flow substantially freely and a defined edge portion laterally surrounding the central portion, and the pile extending substantially uniformly at least over the entirety of the central portion. In a particular aspect, the invention specifically contemplates the provision of web-type stock material having upwardly projecting filamentary elements and a defined periphery, comprising, in combination, a flexible base member for overlying a floor surface in immediately surrounding relation to a liquid egress opening in the surface, the base member having a central hole for register with the egress opening; and a three-dimensional mat carried by the base member and comprising filamentary elements distributed throughout a volume extending horizontally at least over the entire area of the hole and vertically upwardly above the base member to a locality spaced above the base member for engaging and arresting liquid-carried debris such as hair outside and above the egress opening while permitting flow of liquid downwardly into the egress opening. In accordance with the invention, some at least of the filamentary elements extend transversely across the hole and intersect with each other at a multiplicity of points distributed substantially uniformly over the entire area of the hole so as to subdivide the hole into a multiplicity of individually small openings for downward liquid flow into the egress opening, the transversely extending filamentary elements and the base member cooperatively constituting a web having a periphery defined by the base member; and the filamentary elements include a multiplicity of flexible elements projecting upwardly throughout the entire vertical extent of the aforesaid volume and distributed substantially uniformly at least over the entire area of the hole in closely adjacent relation to each other.

The stock material of the invention has utility as a fluid filter for drain openings and the like, to prevent debris from entering of clogging the drain opening, in a wide variety of particular applications, including, without limitation, outdoor drains and waste pipes in yards and pavements, roof drains or downspouts, floor drains, drains for chemical or other industrial plant tanks, and swimming pool, basin, tub, and shower stall drains. It will be understood that the term "floor surface," as used above and in the claims, includes any surface through which such a drain opens, and that the term "liquid egress opening" includes the drain opening through such a surface; where the drain itself has a lateral flange surrounding the opening (typically mounted flush with the tub or other floor), such flange is deemed for present purposes to constitute part of the floor surface.

More particularly, when the stock material of the invention is disposed with the base member in the aformentioned overlying relation to the floor surface, immediately surrounding the liquid egress opening (e.g. drain opening), the mat extends entirely over and projects above the latter opening, permitting flow of water of other liquid therethrough but preventing entry of debris into the drain. Moreover, the upwardly projecting filamentary elements on the mat trap and entangle liquid-carried debris, such a hair, outside and above the drain opening, so that the arrested debris does not clog the opening in a manner that would block or prevent continuing liquid flow into the drain. This result is achieved by the very close spacing and consequent cooperation of the filamentary elements. The flexibility of the filamentary elements affords the important added advantage of avoiding a hazard of injury, for example when the stock material is employed in a basin, bathtub or other location where it is liable to be engaged by an unprotected hand, foot or other portion of the human body.

Thus, in particular embodiments of the present invention there is provided a new article for preventing the clogging of drainpipes of bathtubs, shower stalls, lavatories and the like, particularly due to the accumulation of hair therein, during the taking of showers or washings or the like, preferably made of a suitable flexible and springy plastic material, or of flexible and springy rubber or of any other equally suitable material. The article could be produced by injection molding process or by extrusion process or by any other equally suitable process. The article of the present invention has a preferred mat-like shape which in one example is to be installed over the standard strainers of bathtubs, shower stalls, lavatories and the like, and in another example, comprising the provision of an insertable feature, is to be inserted into the drainpipe openings of bathtubs, shower stalls, lavatories or the like. In this latter example said mat-like shape, hereinafter called insertable mat-like shape, is intended as a replacement of said strainers. In a preferred embodiment, said mat-like shape as well as said insertable mat-like shape comprise a central portion constituted by a net-like structure integral with a surrounding flat thin flexible imperforate strip, the upper faces of which are provided, in several preferred embodiments, with flexible spikes or bristles or with an adherently bonded resilient open lofty integrated web of interengaged continuous crinkled filaments which may be unmodified or modified, such as for example abrasive filaments or foamed filaments, to exert a gripping action over said fallen hair, and in another example, only the upper face of the net-like structure is provided with rough indented openings to exert a gripping action upon the fallen hair. And the lower face of said flat thin flexible imperforate strip constitutes a base for the article, providing several preferred undersurfaces. In reference to the insertable mat-like shape the surrounding flat flexible imperforate strip is integral with a flexible but rigid enough hollow insertable feature which is placed on the lower face of said flat flexible imperforate strip along its inner perimeter, pointing downwards perpendicularly to said insertable mat-like shape.

Optionally, in another preferred embodiment of the article, said mat-like shape and said insertable mat-like shape comprise an upper portion with a mat-like shape constituted by a net-like structure, the upper face of which is provided with said flexible spikes, bristles or open web or with said rough indented openings, and said upper portion constituted by a net-like structure is adherently bonded on its lower face, along an area around its periphery, to the lower portion of the article constituted by a base having a flexible flat thin imperforate central hole defined therein of a size generally corresponding to that of the strainer, and the base providing several preferred undersurfaces. In reference to the insertable mat-like shape the flexible flat imperforate base having a central hole defined therein of a size generally corresponding to that of the drainpipe opening is integral with the hollow insertable feature which is placed on its lower face, along its inner perimeter. Furthermore, in another preferred embodiment of the article the mat-like shape, as well as the insertable mat-like shape, comprise an upper portion with a mat-like shape which is configured by a resilient open lofty intergrated web of interengaged continuous crinkled large diameter filaments bonded together at points of mutual contact, and said web forming an open dimensionally stable tough unitary structure. This unitary open web structure, has one of its surfaces flattened in order to be adherently bonded on this flattened surface along an area around its periphery, to the lower portion of the article constituted by said flexible flat thin imperforate base having a central hole defined therein of a size generally corresponding to that of the strainer, and the base providing several preferred undersurfaces. In reference to the insertable mat-like shape the flexible flat imperforate base having a central hole defined therein of a size generally corresponding to that of the drainpipe opening is integral with the previously mentioned insertable feature which is also placed as described above.

The article of the present invention in some of its preferred embodiments is preferably dimensioned in such a way as to cover with its base the flange and the surrounding area adjacent to the outer perimeter of the flange and, in other ot its preferred embodiments, it is preferably dimensioned to cover with its base only the flange, while in all the preferred embodiments of the article the net-like structure and/or the open web occupy the area defined by the strainer or by the drainpipe opening.

The article of the present invention in its most preferred embodiments prevents hair or hairpins, or any other object, carried away with the water flow during the taking of showers or washings or the like, from entering and clogging the drainpipes of bathtubs, shower stalls, lavatories and the like, through an entangling and gripping action carried out by the spikes or bristles or open lofty web of continuous crinkled filaments or by rough indented openings of the net-like structure, in conjunction with a blocking action carried out by the shape of the article which covers the entire strainer as well as the drainpipe opening of bathtubs, shower stalls, lavatories and the like, and both said actions being exerted upon the fallen hair, hairpins or any other object carried away with the water flow, whcn the article is installed in a preferred embodiment over said strainers, and in another preferred embodiment over the drainpipe opening with the insertable feature, inserted into the drainpipe opening, while the net-like structure and/or the open web allow, with a plurality of large enough openings, the free flow of running water without hair into the drainpipe opening.

OBJECTS OF THE INVENTION

Accordingly, it is one of the major objects of the present invention to provide a new article which prevents hair, hairpins or any other object carried away with the water flow during the taking of showers or washings or the like, from entering and clogging the drainpipes of bathtubs, shower stalls, lavatories and the like, by means of an entangling and gripping action carried out by flexible spikes or bristles or by a resilient open lofty integrated web of continuous crinkled filaments, or by rough indented openings of the net-like structure, in conjunction with a blocking action carried out by the shape of the article which covers the entire strainer as well as the drainpipe opening of bathtubs, shower stalls, lavatories or the like, and both said actions being exerted upon the fallen hair, hairpins or any other object from entering and clogging said drainpipes.

It is another object of the present invention to provide an article of the above character which body, in some preferred examples, is constituted by a net-like structure with a plurality of openings which are large enough to allow the free flow of running water without hair into the drainpipes during the taking of showers or washings or the like.

It is another object of the present invention to provide an article of the above character having flexible spikes or bristles or an open lofty integrated web of crinkled filaments on the upper face of the net-like structure, or rough indented openings of said net-like structure, to exert an entangling and gripping action upon the fallen hair carried away with the water flow.

It is another object of the present invention to provide an article of the above character wherein the integrated web of crinkled filaments is open to allow through large enough openings, the free flow of running water without air into said drainpipes.

It is another object of the present invention to provide an article of the above character which body has a flexible flat imperforate base with several preferred undersurfaces to provide a secure installation.

It is another object of the present invention to provide an article of the above character which body, in some preferred examples is preferably dimensioned to cover, with its base, the flange and the surrounding area adjacent to the outer perimeter of the flange, and in other preferred examples, is preferably dimensioned to cover, with its base, only the flange.

It is another object of the present invention to to provide an article of the above character which in one example is to be installed over the strainers and in another example has an insertable feature which is to be inserted into the drainpipe opening to replace said strainers.

It is another object of the present invention to provide an article of the above character which is shaped to cover, in one example, the entire strainer, and in another example, the drainpipe opening of bathtubs, shower stalls, lavatories or the like, in order to exert a blocking action upon the fallen hair carried away with the water flow during the taking of showers or washings or the like.

It is another object of the present invention to provide an article of the above character which constitutes a means to actually eliminate the cause of the aforementioned problem in a simple, harmless and inexpensive way.

It is yet another object of the present invention to provide an article of the above character which is easy to clean after each use and it is wear resistant, while its flexible spikes, bristles or integrated open web of continuous crinkled filaments will retain their shape and will not rust or shed.

It is a further object of the present invention to provide an article of the above character which is easy to manufacture and mass produce at low cost.

BRIEF DESCRIPTION OF THE DRAWINGS

While the Specification concludes with claims particularly pointing out and distinctly claiming the subject matter of the present invention, it is believed that the invention can be more readily understood form the following description taken in connection with the accompanying drawings, in which:

FIG. 1 is a perspective view of one of the preferred exemplary embodiments of the article. The embodiment illustrated in this figure applies to all of the preferred embodiments of spikes, bristles or open web or rough indented openings. This figure is scaled to about one of the actual sizes used on bathtubs and the like.

FIG. 2 is a perspective view in large scale of a preferred exemplary embodiment of spikes.

FIG. 3 is a perspective view of a transverse cross section of the preferred exemplary embodiment illustrated in FIG. 1 taken along section line 3—3 of FIG. 1.

FIGS. 6 and 7 are perspective views in large scale of preferred exemplary embodiments of spikes.

FIGS. 8, 9 and 10 are perspective views in large scale of preferred exemplary embodiments of bristles.

FIG. 14 is a perspective view of a transverse cross section of another preferred exemplary embodiment of the article, taken along section line 14—14 of FIG. 1 illustrating the insertable feature. Although the preferred embodiment illustrated in FIG. 1 is not the embodiment illustrated in this figure, both embodiments are quite similar for illustrative purposes. The embodiment illustrated in this figure applies to all of the preferred embodiments of spikes, bristles or open web or rough indented openings. This figure is scaled to about one of the actual sizes used on bathtubs and the like.

FIG. 15 is a perspective view of the reduced version of the preferred embodiment of the article illustrated in FIG. 14, showing the adhesive base and a cross section view of the insertable feature. This figure is scaled to about the actual size, used on bathtubs and the like.

FIG. 16 is a perspective view similar to FIG. 15 of the preferred embodiment of the article illustrated in FIG. 14, showing the base with rows of suction cups and a cross section view of the insertable feature. This figure is scaled to about one of the actual sizes used on bathtubs and the like.

DETAILED DESCRIPTION OF THE PREFERRED EMBODIMENT

Figure 4:
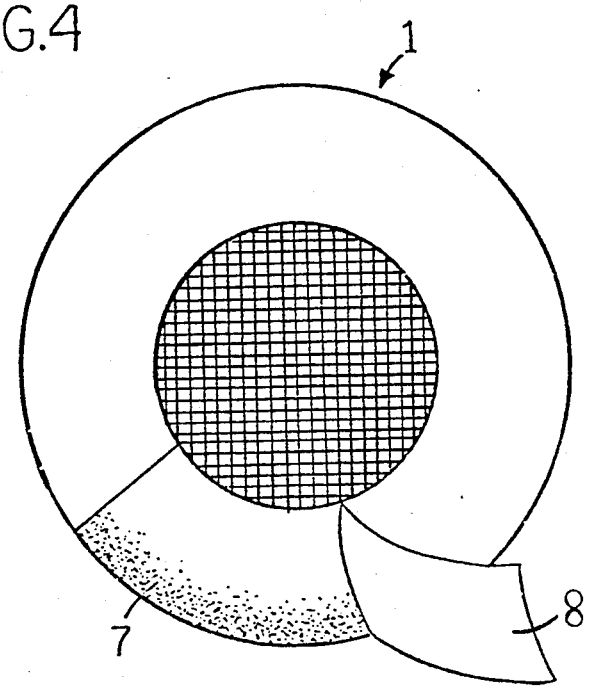
FIG. 4 is a plan view of the adhesive base of the preferred embodiment illustrated in FIG. 1. This plan view is also applicable to the preferred embodiments illustrated in FIGS. 12 and 13. The base illustrated in this figure optionally applies to all of the preferred exemplary embodiments of spikes, bristles or open web.

While this invention is susceptible of embodiment in many different forms, there is shown in the drawings and will herein be described in detail preferred embodiments of the invention and modifications thereof, with the understanding that the present disclosure is to be considered as an exemplification of the principles of the invention and is not intended to limit the invention to the embodiments illustrated. The scope of the invention will be pointed out in the appended claims.

The article of the present invention has a preferred circular mat-like shape which, in one preferred example is to be installed over the conventional strainers of bathtubs, shower stalls, lavatories and the like, and in another preferred example comprises the provision of an insertable feature which is to be inserted into the drainpipe openings of bathtubs, shower stalls, lavatories and the like. In this latter example the circular mat-like shaped article is intended as a replacement of said strainers. The article, in all its preferred embodiments, is made preferably of a suitable flexible and springy plastic material, or of flexible and springy rubber, or of any other equally suitable material, and it could be produced by injection molding process or by extrusion process, although the injection molding process is considered more appropriate to obtain some of the preferred embodiments of the preferred flat circular shapes of the article. If injection molding process is employed, different molds could be used, as it will be obvious to those skilled in the art as per the detailed description and drawings of the article, to obtain the most preferred circular shapes and the different spikes or bristles. If extrusion process is employed, different extruder dies could be used, as it will be obvious to those skilled in the art, to obtain some of the preferred embodiments of the preferred flat circular shapes of the article as well as the different spikes or bristles. For example, in some of the preferred embodiments of the article the circular upper portion of said article constituted by a net-like structure could be extruded as a ribbon and then cut circularly to obtain the desired flat circular shape. This also applies in certain cases to the circular flat imperforate lower portion of the article. Said flat circular shapes could be produced by extrusion process similar to that utilized to extrude thermoplastic articles with spikes or bristles and optionally formed flat and tubular profiles disclosed in the U.S. Pat. No. 3,329,998 issued to C. Stohr on July 11, 1967, and in U.S. Pat. No. 3,387,069 issued to C. Stohr on June 4, 1968, and U.S. Pat. No. 3,923,442 issued to Arno Stohr on Dec. 2, 1975, and U.S. Pat. No. 3,867,953 issued to Arno Stohr on Feb. 25, 1975, said patents being hereby incorporated herein by reference. Also both aforementioned processes could be used in association, and integrating means could be employed in an additional stage to adherently bond together different features. Of course, any other equally suitable process could also be employed.

All the dimensions of the article of the present invention should be adapted to the different sizes of strainers and drainpipes openings of bathtubs, shower stalls, lavatories and the like. Therefore, in the description that follows there will be given dimensions which intend to be only exemplary of one of said sizes and which could be subject in practice to modifications and adjustments whenever convenient. Furthermore, the article of the present invention, in some of its preferred embodiments is preferably dimensioned in such a way as to cover with its base the flange and the surrounding area adjacent to the outer perimeter of the flange, and in other of its preferred embodiments, the article is preferably dimensioned to cover with its base only the flange. All of the preferred embodiments of the article are suitable to be used in bathtubs, as well as in shower stalls, lavatories or the like. Although some of the preferred embodiments of the article are particularly suitable for one or the other. Therefore, there is intended a big size of the preferred embodiments of the article to be used in bathtubs, shower stalls, and the like and a small size to be used in lavatories and the like.

Figure 5:
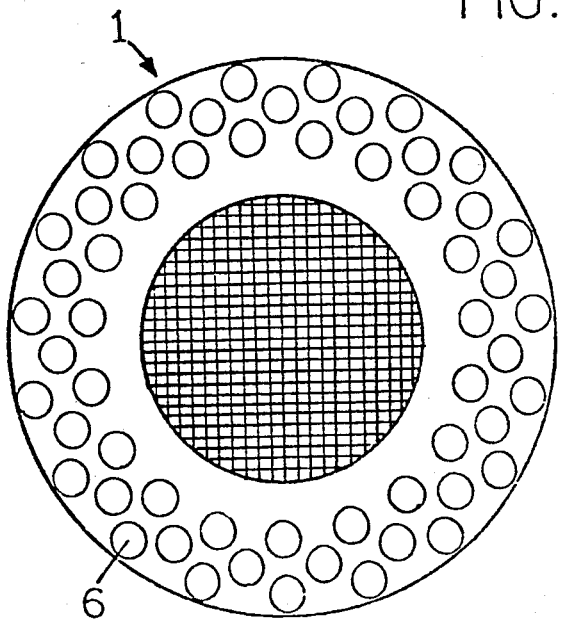
FIG. 5 is a plan view of the base of the preferred embodiment illustrated in FIG. 1 showing rows of suction cups. This plan view is also applicable to the preferred embodiments illustrated in FIGS. 12 and 13. The base illustrated in this figure optionally applies to all of the preferred exemplary embodiments of spikes, bristles or open web, or rough indented openings.

Referring now to FIG. 1 there is shown one of the most preferred exemplary embodiments of the article, a circular mat-like shape 1 suitable to be used over strainers of bathtubs, shower stalls, lavatories and the like. The circular shape 1 comprises a circular central portion constituted by a net-like structure with a plurality of openings 4 integral with a flexible circular surrounding flat thin imperforate strip 2, the lower face of which constitutes the base of the article, providing several preferred undersurfaces, and adhesive undersurface 7, with removable backing paper 8 (FIG. 4) which is entirely coated with any conventional commercially available pressure sensitive adhesive compatible with the plastic material used, which adhering properties are suitable for porcelain, cast-iron, steel, fiberglass and other plastic surfaces of bathtubs, shower stalls, lavatories and the like, or an undersurface provided, preferably with three rows of suction cups 6 (FIGS. 3 and 5) (having for example an approximate diameter of 5/16"). FIG. 5 shows three rows of suction cups 6 in a preferred disposition, although if desired, only two rows of suction cups 6 (see FIG. 3) could be employed or yet a plain, self sealing undersurface, (not shown). The upper surface of the net-like structure 4 and preferably the surrounding circular flat imperforate strip 2 bears a pluarlity of external ribs 3 ending in flexible spikes 5, 10, 11 (FIGS. 2, 7 and 6) or bristles 12, 13, 14 (FIGS. 8, 9 and 10) uniformly spaced at a minimal distance from each other, and the internal ribs 3' support the whole body of the circular shape 1. FIG. 1 shows a sample of spikes 5 with Burdock-like hooked tips. Preferably there are provided spikes 5, 10, 11 or bristles 12, 13, 14, over the upper face of the circular surrounding imperforate strip 2, on the other hand the external ribs 3 over the outer face of the imperforate strips 2 may be optional, and the same applies to the circular shape 20, in the embodiment illustrated in FIG. 14, which does not show the external ribs 3 over the circular surrounding imperforate strip 2. The entire upper face of the net-like structure with a plurality of openings 4 and of the circular surrounding imperforate strip 2 are provided, in several preferred exemplary embodiments, with the flexible spikes 5, 10, 11 or bristles 12, 13, 14, or with an adherently bonded flexible open lofty integrated web 15 (FIG. 11) of interengaged extruded continuous crinkled large diameter filaments of thermoplastic material, welded together at points of mutual contact to form the integrated open web according with an integration treatment using commercially available liquid hardenable adhesive bonding resin, which upon hardening, permanently adheres the filaments together as a unitary structure. This liquid may be applied by immersing the web in a bath thereof or by spraying the web therewith. Such liquids may be in the form of a solvent solution of the bonding resin, as a hot melt of the resin or in any other convenient form. Hardening of such liquids will of course depend upon their form. Hardening of solvent solutions will be by solvent evaporation, and hardening the melt will be by cooling. The open web 15 has one of its major surfaces flattened 25 (see FIG. 11) to provide an excellent contact surface for lamination when it is laminated to the entire upper face of the net-like structure 4, and to the entire upper face of the surrounding circular flat imperforate strip 2, these being the substratum for the lamination of the web 15. The integrated open web 15 is laminated to the upper face of the plastic net-like structure with a plurality of openings 4 that constitutes the circular central portion and to the upper face of the flexible circular surrounding flat imperforate strip 2, using conventional adhesives and coating the flattened surface 25 (FIG.11) of the web with the liquid hardenable adhesive by any convenient means, e.g. brush, spray or roll coating and pressing the substrate against the adhesive coated surface with light or moderate pressure. Once the adhesive cures, the web and substrate become permanently adherently bonded together forming a highly dimensionally stable laminate. The web could also be laminated without using adhesives by having the molten thermoplastic filaments fall upon the upper face of the net-like structure 4 and of the surrounding imperforate strip 2, and upon cooling form an adherently bond between the substrate surface and the web.

Optionally, in another preferred embodiment of the opening web 15, the web 15 comprises abrasive filaments, and yet in another preferred embodiment the web 15 comprises foamed filaments, so that the filaments could exert also a gripping action over the fallen hair which have been entangled within the web 15. To produce these other preferred embodiments of filaments, the completed web is modified, prior to integration or lamination by the addition of particulate materials such as abrasive grains to produce abrasive filaments or by the addition of gases or blowing agents to produce foamed filaments. Also the complete web may be modified by any other means equally suitable to obtain filaments with the desired gripping action. The open lofty integrated web 15 of interengaged extruded continuous crinkled large diameter filaments is preferably subjected to extrusion process and modification treatments to produce abrasive and foamed filaments as well as integration and lamination treatments similar to those utilized to extrude filaments as well as to integrate and laminate the open web of filaments, or to produce abrasive and foamed filaments disclosed in the U.S. Pat. No. 3,837,988 issued to D. E. Hennen et al on Sept. 24, 1974, said patent being hereby incorporated herein by reference.

Figure 11:
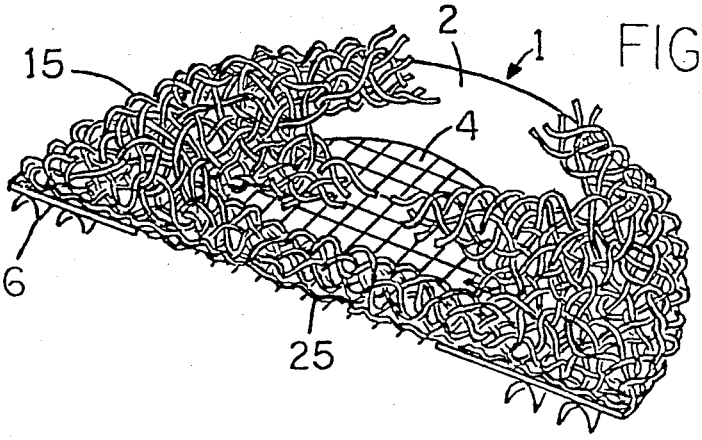
FIG. 11 is a perspective view of a transverse cross section of the preferred exemplary embodiment illustrated in FIG. 1 taken along section line 11—11 of FIG. 1, showing the preferred exemplary embodiment of the open web of crinkled filaments.
Figure 18:
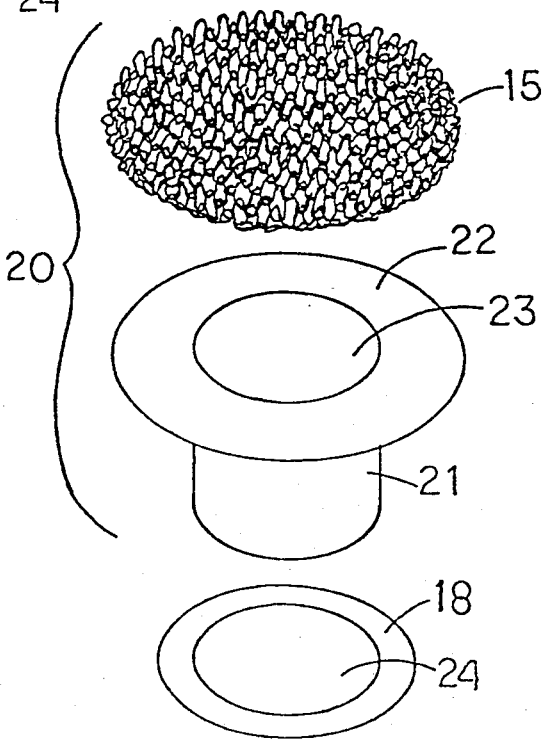
FIG. 18 is an exploded perspective view similar to FIG. 17 showing the upper portion of said article as configured by the preferred embodiment of the open web of crinkled filaments.

Whereas the teachings of the hereinbefore incorporated U.S. Pat. No. 3,837,988 are concerned with applications of the open web to a composite mat especially suited for use as a floor covering, the intended use of the open web in the present invention is as a mean to avoid clogging of drainpipes of bathtubs, shower stalls, lavatories and the like, through the entangling action exerted by said open web of crinkled filaments upon the fallen hair, hairpins or any other object carried away with the water flow during the taking of showers or washings or the like, whether the open web is adherently bonded to the upper face of the circular central portion constituted by a net-like structure 4 and to the surrounding circular flat imperforate strip 2 as shown in FIG. 11 or the web is adherently bonded to the circular mat-like shaped upper portion constituted by a net-like structure 4 shown in FIG. 12, or whether the integrated open web is configured to define the circular mat-like shaped upper portion of some of the preferred embodiments of the article as shown in FIGS. 13 and 18, while the openness of the web serves the purpose of allowing the free flow of running water without hair into the drainpipe opening.

The description of the open web 15 and the reference to its related manufacturing process, such as has been given for the preferred circular shape 1 in the preferred embodiment of the circular shape 1 shown in FIGS. 11, 12 and 13, and to the circular shape 20 in the preferred embodiments shown in FIGS. 14 and 18 which will be described later.

In FIG. 1 as well as in most other figures the net-like structure is simplified for clarity purposes except in FIGS. 2, 6, 7, 8, 9 and 10 where the net-like structure is illustrated in large scale. The circular mat-like shape 1 in the preferred embodiment illustrated in FIG. 1 is preferably dimensioned in such a way as to cover entirely the conventional circular strainer 19 (shown in FIGS. 12 and 13) with the circular central portion constituted by a net-like structure with a plurality of openings 4, and preferably to cover entirely the flange 18 (shown in FIGS. 12 and 13) and to cover also a suitable distance over the surrounding area adjacent to the outer circumference of the flange 18 with the flexible circular surrounding flat imperforate strip 2. Therefore the circumferential dimension of said circular central portion constituted by a net-like structure with a plurality of openings 4 should be preferably adapted to the circumferential dimensions of said strainers and the dimension of the outer circumference of the surrounding circular flat thin flexible imperforate stripes 2 should be preferably such as to extend a suitable distance over the surrounding area adjacent the outer circumference of the flange 18 to permit a secure installation of the base of the article over said area. Also the suction cups 6 are placed on the lower face of the surrounding circular flat imperforate strip 2, over said area. On the other hand, the adhesive 7 is coated over the entire lower face of said imperforate strip 2. There is given an example of dimensions of the circular shape 1 in the embodiment illustrated in this figure, adapted to one of the standard strainers of bathtubs and the like: diameter of the outer circumference of the circular surrounding imperforate strip 2 preferably between about $4\frac{5}{8}''$ to $5\frac{1}{8}''$; diameter of the circular central portion constituted by a net-like structure 4 preferably approximately $2\frac{3}{8}''$; width of the surrounding circular flat imperforate strip 2 preferably between about $1\frac{1}{8}''$ to $1\frac{3}{8}''$; the area covered by rows of suction cups 6 on the lower face of said circular strip 2 extends from the outer circumference of said strip 2 inward up to the outer circumference of the flange, preferably between about $\frac{3}{4}''$ to $1''$; diameter of suction cups 6 preferably approximately $5/16''$. The aforementioned dimensions also apply to all the preferred embodiments of spikes 5, 10, 11 or bristles 12, 13, 14 or open web 15 which are provided on the upper face of this circular shape 1, or to another preferred embodiment of rough indented openings (not shown) provided only on the upper face of the net-like structure with a plurality of openings 4 of the circular shape 1 as well as of the circular shape 20 in some of their preferred embodiments, and which will be explained later in more detail.

Figure 12:
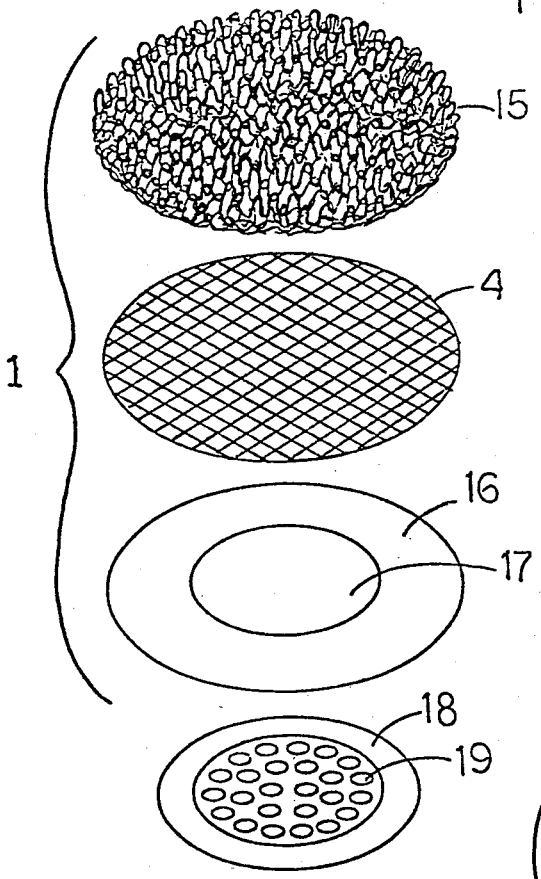
FIG. 12 is an exploded perspective view in a reduced scale showing a modification of the different parts of the preferred exemplary embodiment of the article of FIG. 1 and another manner of assembling the different parts and the relationship of said parts to a conventional strainer. The embodiment of the article illustrated in this figure applies to all of the preferred embodiments of spikes, bristles, open web or rough indented openings, which are provided on the upper face of the net-like structure. This figure shows the embodiment of the open web.
Figure 13:
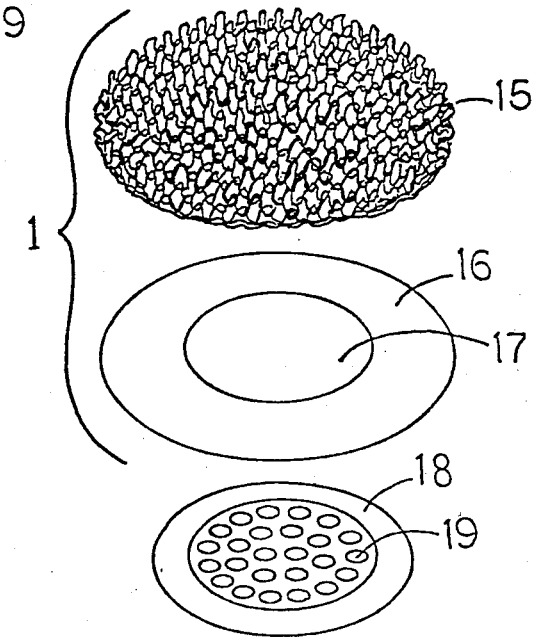
FIG. 13 is an exploded perspective view, in a reduced scale similar to FIG. 12, showing the upper portion of said article as configured by the preferred embodiment of the open web of crinkled filaments.

Referring now to the preferred embodiments of spikes 5, 10, 11 or bristles 12, 13, 14 which are provided over the upper face of the preferred circular shapes 1 and 20 (FIGS. 1 and 14) on any of the preferred embodiments of these circular shapes 1 and 20 shown in FIGS. 1, 12, 14 and 17, although not illustrated in FIG. 12 where there is shown instead the preferred embodiments of the open web 15. And said spikes 5, 10, 11 or bristles 12, 13, 14 being uniformly spaced at a minimal distance from each other over the net-like structure 4 and also over the imperforate strip 2 (the latter only on the embodiments shown in FIGS. 1 and 14). There is shown in FIG. 2 the external ribs 3 of the net-like structure 4 ending in spikes 5 with Burdock-like hooked tips wherein pairs of adjacent spikes 5 (or bristles, not shown) are bent against each other. Internal ribs 3' support said external ribs 3.

FIG. 6 illustrates the external ribs 3 of the net-like structure 4 ending in spikes 11 with straigh tips and the internal ribs 3'.

FIG. 7 illustrates external ribs 3 of the net-like structure 4 ending in spikes 10 with straight tips which are disposed in groups of three spikes 10 radially arranged preferably on a same plane on said external ribs 3. Each group of three spikes opposes each other diagonally and alternately according to the following disposition: every two parallel external ribs 3, said groups of three radially disposed spikes 10 are spaced at a minimal distance from each other, preferably at the intersection of the external and internal ribs 3 and 3' of the net-like structure 4 and every two intercalated parallel external ribs 3 the radially disposed groups of spikes 10 are spaced at a minimal distance from each other, preferably at the middle of each of the segments of the external ribs 3 that are so determined by two of said intersections. The middle spikes 10 of each group of three spikes 10 is perpendicular to the external ribs 3, and the outer two spikes 10 of each group of spikes 10 are at an angle 9 to the external rib 3 so that the outer spikes 10 of every two intercalated groups cross each other or that at least their tips are in touch, thus forming a net-like surface against the fallen hair. This embodiment in particular allows the provision of large enough openings of the net-like structure 4, due to the abovementioned arrangement of spikes. If desired, the rows of radially disposed groups of spikes 10 could be increased as well as the height of the spikes 11, proportionately to the enlargement of the openings.

FIG. 8 illustrates the external ribs 3 of the net-like structure 4 ending in bristles 12 (or spikes, not shown) grouped as small inverted cone-shaped bunches, and the internal ribs 3'.

Figure 9:
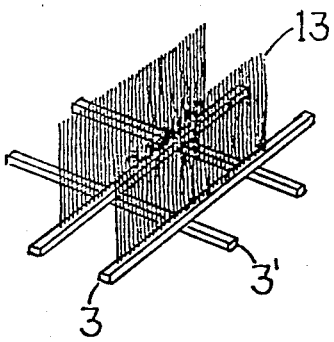

FIG. 9 illustrates rows of contiguous bristles 13 (or spikes, not shown) over the external ribs 3 and the internal ribs 3'.

Figure 10:
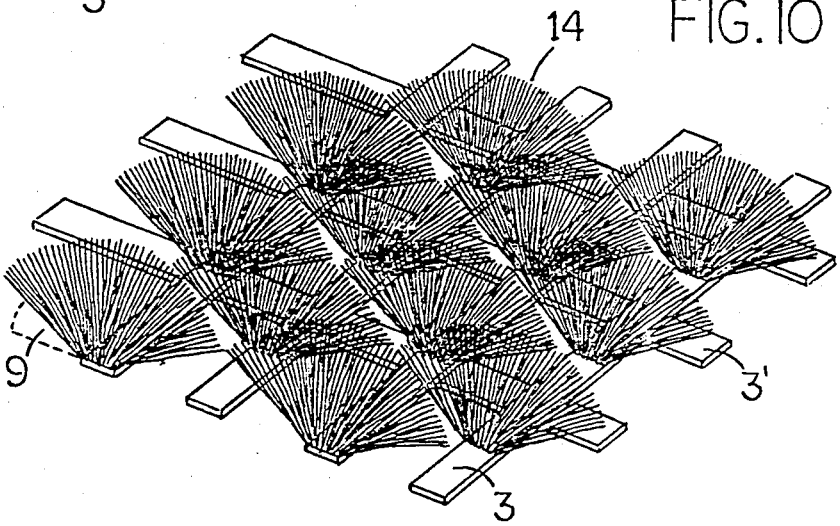

FIG. 10 illustrates external ribs 3 ending in bristles 14 (or spikes, not shown) grouped in a fan-like shape. Each fan-shaped group opposes each other diagonally and alternately according to the following disposition: every two parallel external ribs 3, groups of bristles 14 in a fan-like shape are spaced at a minimal distance from each other, preferably at the intersections of the external and internal ribs 3 and 3' of the net-like structure 4, and every two intercalated parallel external ribs 3, groups of bristles 14, in a fan-like shape are spaced preferably at the middle of each one of the segments of the external ribs 3 that are so determined by two of the said intersections, being the outer edges of the fan-like shaped groups of bristles 14 at an angle 9 to the external ribs 3, so that the outer bristles 14 (or spikes) of every two intercalated fan-like shaped groups cross each other, or at least their tips are in touch, thus forming a net-like surface against the fallen hair. This embodiment in particular allows the provision of large enough openings for the net-like structure 4, due to the above mentioned arrangement of bristles. If desired, the rows of fan-like shaped groups of bristles 4 (or spikes), could be increased as well as the height of the bristles 14 (or spikes) proportionately to the enlargement of the openings.

FIG. 11 shows the preferred circular mat-like shape 1 of FIG. 1 illustrating the preferred exemplary embodiment of the resilient open lofty integrated web 15 of interengaged irregularly coiled large diameter filaments. In this figure the filaments have been slightly exaggerated for clarity purposes. The open web 15 is adherently bonded on its flattened surface 25 to the upper face of the net-like structure 4 of the circular central portion and to the upper face of the flexible circular surrounding flat imperforate strip 2 of said circular shape 1, as has been previously described, and also comprises unmodified or modified abrasive or foamed filaments. For the preferred embodiment of the open web 15 illustrated in this figure as well as in FIGS. 12, 13 and 18 a suitable diameter of the filaments may be between about 5 to 65 mils, and preferably 10 to 35 mils.

Figure 17:
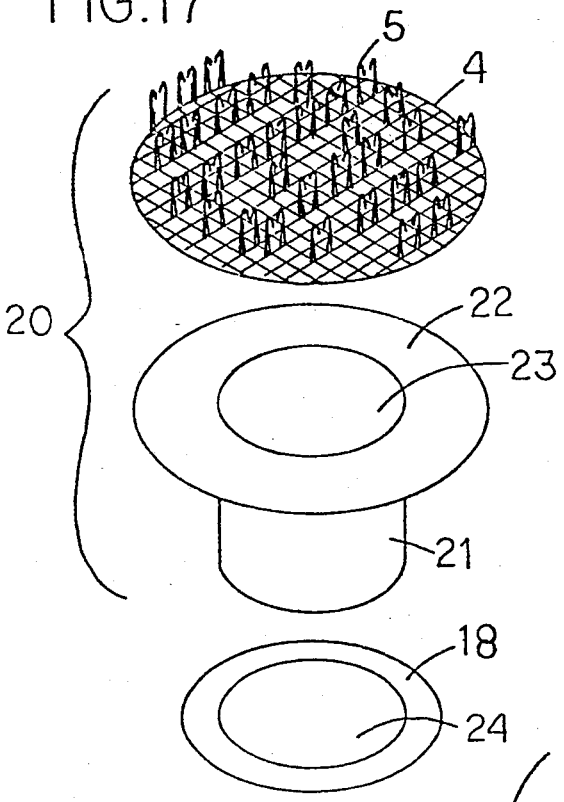
FIG. 17 is an exploded perspective view showing a modification of the different parts of the preferred exemplary embodiment of the article of FIG. 14 and another manner of assembling the different parts and the relationship of said parts to the drainpipe opening and the flange. This figure shows a sample of a preferred embodiment of spikes. The embodiment illustrated in this figure applies to all of the preferred embodiments of spikes, bristles, open web or rough indented openings which are provided on the upper face of the net-like structure.

The embodiment of the open web 15 as illustrated in FIG. 11 is also applicable to the preferred embodiments of the article illustrated in FIGS. 12, 14 and 17.

The spikes or bristles should be spaced preferably at a minimal distance so as to increase the effectiveness of the entangling action while the openings of the net-like structure and the openings of the open web should have suitable dimensions to allow the free flow of running water without hair into the drainpipe opening.

An example of a height of spikes 5, 10, 11, or bristles 12, 13, 14 or open web 15 which might be suitable for all the preferred embodiments of the circular shape 1 and 20 may be between about $\frac{1}{4}$ "to $\frac{1}{2}$", and preferably $\frac{1}{4}$".

Referring now to FIG. 12 there is shown a modification of the different parts of the preferred exemplary embodiment of the circular shape 1 of FIG. 1 and of another manner of assembling the different parts. In the preferred embodiment illustrated in this figure said circular shape 1 comprises an upper portion with a circular mat-like shape constituted by a net-like structure with a plurality of openings 4, the upper face of which is provided, as illustrated in this figure, with the previously described adherently bonded resilient open lofty web 15 of interengaged continuous crinkled, unmodified or modified abrasive or foamed, large diameter filaments, or with said flexible spikes 5, 10, 11 or bristles 12, 13, 14. The filaments of the web 15 in this figure as well as in FIGS. 13 and 18 are simplified for clarity purposes. Said circular mat-like shaped upper portion constituted by a net-like structure with a plurality of openings 4 is in turn adherently bonded, on its lower face along an area around its periphery, to the lower portion of the article constituted by a flexible circular flat thin imperforate strip which constitutes a base 16 having a circular central hole 17, defined therein of a size preferably corresponding to that of the strainers, and the base providing the previously mentioned several preferred undersurfaces, i.e., an adhesive undersurface 7 (see FIG. 4) which is coated entirely with any conventional commercially available pressure sensitive adhesive, as previously mentioned, or an undersurface provided, preferably with three rows of suction cups 6 (see FIG. 5) or a plain self sealing undersurface (not shown). The circular mat-like shaped upper portion constituted by a net-like structure with a plurality of openings 4 is adherently bonded to the lower portion of the article constituted by said flexible circular flat thin imperforate base 16 with a circular central hole 17, using conventional adhesives and coating the flat surface of the circular imperforate base 16 with the liquid hardenable adhesive by any convenient means, e.g. brush, spray or roll coating, and pressing the circular net-like structure with a plurality of openings 4, agains the adhesive coated surface with light or moderate pressure. Once the adhesive cures the circular mat-like shaped upper portion constituted by the net-like structure 4 and the substrate constituted by the flexible circular flat thin imperforate base 16, become permanently adherently bonded together forming a highly dimensionally stable laminate. Said upper portion constituted by a net-like structure 4 and said lower portion constituted by said flexible circular flat imperforate base 16 may be produced, as suggested before, by extrusion process, wherein said upper portion, which would be provided in some preferred embodiments with said spikes or bristles, and said lower portion could be extruded as ribbons, and then cut circularly to obtain the desired flat circular shapes. Also, the lower portion could be produced by injection molding process if the lower face of said lower portion is provided with suction cups 6. The circular mat-like shape 1 in the preferred embodiment illustrated in this figure is preferably dimensioned in such a way as to cover entirely the standard circular strainer 19, with the circular central portion defined by the net-like structure 4 which extends over the circular central hole 17 of the circular flat imperforate base 16 and to cover entirely the flange 18 and to cover also a suitable distance over the surrounding area adjacent to the outer circumference of the flange 18 with the circular flat imperforate base 16. This proporation is evident in the relationship of the different parts of the circular shape 1 to the strainer 19 and the flange 18, in this FIG. 12 and also in FIG. 13. Therefore, the circumferential dimension of the circular central hole 17 of the circular flat flexible imperforate base 16 should preferably be adapted to the circumferential dimensions of said strainers and the dimension of the outer circumference of the circular flat imperforate strip 16 should preferably be such as to extend a suitable distance on the flange 18 to permit a secure installation of the base over said area. Also the suction cups 6 are placed on the lower face of the circular flat imperforate base 16 over said area. On the other hand, the adhesive 7 is coated over the entire lower face of the circular flat imperforate base 16. The aforementioned adaptation of the dimensions of this embodiment to the conventional strainers and surrounding area also applies to the embodiment of the circular shape 1 illustrated in FIG. 13. There is given an example of dimensions of the circular shape 1 in the embodiment illustrated in this figure, adapted to one of the conventional strainers of bathtubs, and the like: diameter of the circular upper portion constituted by the net-like structure 4 preferably between about $4\frac{5}{8}''$ to $5\frac{1}{8}''$, diameter of the inner circumference of the circular flat imperforate base 16 preferably approximately $2\frac{3}{8}''$, width of circular flat imperforate base 16 preferably between about $1\frac{1}{8}''$ to $1\frac{3}{8}''$. The area covered by rows of suction cups 6, on the lower face of the circular base 16 extends from the outer circumference of the base 16 inward up to the outer circumference of the flange preferably between about $\frac{3}{4}''$ to 1", diameter of suction cups 6 preferably approximately 5/16". The example of dimensions given in this figure also applies to the embodiment of the circular shape 1 illustrated in FIG. 13.

Turning now to FIG. 13 there is shown a modification of the different parts of the preferred exemplary embodiment of the circular shape 1 of FIG. 1 and of another manner of assembling the different parts. In the peferred embodiment illustrated in this figure said circular shape 1 comprises an upper portion with a circular mat-like shape being configured by said resilient open lofty integrated web 15 described earlier, of interengaged continuous crinkled unmodified or modified abrasive or foamed, large diameter filaments of thermoplastic material welded together at points of mutual contact and integrating means, previously mentioned, adherently bonded to at least a portion of said filaments to provide structural integrity to said web in order to constitute a tough unitary structure, said open web 15 being resilient but having the necessary stiffness to be configured to define said circular mat-like shape. The web 15 has one major surface flattened 25 (FIG. 11) containing a higher concentration of filaments adjacent the flattened surface 25 than within the inner portion of said web 15 to provide an excellent contact surface when said web 15, configured to define said circular mat-like shape is adherently bonded, on its flattened surface 25, to the lower portion of the article, constituted by a flexible circular flat thin imperforate base 16 having a circular central hole 17 defined therein as stated earlier of a size generally corresponding to that of the strainers, and the lower face of the base 16 also provides the previously described adhesive undersurface 7 (see FIG. 4), the undersurface with rows of suction cups 6 (see FIG. 5), or the plain self sealing undersurface (not shown). The circular mat-like shaped upper portion being configured by said open web 15 is adherently bonded to the lower portion of the article, constituted by said flexible circular flat imperforate base 16 having a circular central hole 17, using conventional adhesives and coating the flat surface of the circular imperforate base 16 with the liquid hardenable adhesive by any convenient means, e.g. brush, spray or roll coating, and pressing said circular open web 15 against the adhesive coated surface with light or moderate pressure, as described before for the preferred embodiment shown in FIG. 12. Once the adhesive cures, the circular mat-like shaped upper portion configured by said open web 15, and the substrate constituted by the flexible circular flat imperforate base 16, become permanently adherently bonded together forming a highly dimensionally stable laminate. In this embodiment the open web 15 is produced as stated before, by extrusion process and the lower portion 16 could be, for example, extruded as a ribbon and then cut circularly, or it could be produced by injection molding process if the lower face of said circular flat imperforate base 16 is provided with suction cups 6. This embodiment is also preferably dimensioned as the embodiment of FIG. 12, to cover entirely the conventional circular strainer 19 with the circular central portion defined by the open web 15, which extends over the circular central hole 17 of the circular flat imperforate base 16, and to cover entirely the flange 18 and to cover also a suitable distance over the surrounding area adjacent to the outer circumference of the flange 18 with said circular flat imperforate base 16. The diameter of the circular upper portion configured by the open web 15 as well as all the other dimensions of this embodiment, are the same as the ones given in the example in FIG. 12.

Referring now to FIG. 14 there is shown another most preferred exemplary embodiment of the article wherein the circular mat-like shaped article comprises an insertable feature which is to be inserted into the drainpipe openings of bathtubs, shower stalls, lavatories and the like, when said circular mat-like shaped article is installed over said drainpipes. The insertable mat-like shape 20 illustrated in this figure comprises, as previously described for the circular shape 1 in the embodiment of FIG. 1, a circular central portion constituted by a net-like structure with a plurality of openings 4 integral with a flexible circular surrounding flat thin imperforate strip 2, the lower face of which constitutes a base for the article providing several preferred undersurfaces, and adhesive undersurface 7 with removable backing paper 8 (see FIG. 15) described earlier in FIG. 1, or an undersurface provided preferably with three rows of suction cups 6 (see FIG. 16), also previously described in FIG. 1, or a plain self-sealing undersurface (not shown). And the circular flat imperforate strip 2 further being integral with a flexible but rigid enough hollow cylinder 21 (see also FIG. 15 and 16, showing a cross section view), which is placed on the lower face of said imperforate strip 2 along its inner circumference pointing downwards perpendicularly to the circular shape 20. The upper face of the circular central portion constituted by a net-like structure 4 and of the flexible circular flat imperforate strip 2 is provided with said spikes 5, 10, 11 or bristles 12, 13, 14 or open web 15. FIG. 14 shows a sample of spikes 11.

The insertable circular mat-like shape 20 in the preferred embodiment illustrated in this figure is preferably dimensioned in such a way as to cover entirely the drainpipe opening 24 (FIGS. 17 and 18) with the circular central portion constituted by a net-like structure with a plurality of openings 4, and to cover entirely the flange 18 (FIGS. 17 and 18), and to cover also a suitable distance over the surrounding area adjacent to the outer circumference of the flange 18 with the circular imperforate strip 2. (These proportions are shown in the embodiments of the circular shape 20 illustrated in FIGS. 17 and 18). Therefore, the circumferential dimension of said circular central portion constituted by a net-like structure 4 should preferably be adapted to the circumferential dimension of the drainpipe openings, and the dimension of the outer circumference of the circular surrounding flat imperforate strip 2 should preferably be such as to extend a suitable distance on the surrounding area adjacent to the outer circumference of the flange 18 to permit a secure installation of the base over said area. Also the suction cups 6 are placed on the lower face of the circular surrounding imperforate strip 2 over this area. On the other hand, the adhesive 7 is coated over the entire lower face of the imperforate strip 2. And the circumferential dimensions of the hollow cylinder 21, being such as to adapt to the circumferential dimensions of the drainpipe opening 24 and the length of the hollow cylinder 21 being such as to extend a suitable distance inside the drainpipe opening 24 and the hollow cylinder being flexible but having the necessary stiffness in order to exert the required pressure against the walls of the drainpipe opening, when it is inserted into the drainpipe opening 24. There is given an example of dimensions of the circular shape 20 in the embodiment illustrated in this figure adapted to one exemplary drainpipe opening of bathtubs and the like: diameter of the outer circumference of the circular surrounding flat imperforate strip 2 preferably between about $4\frac{5}{8}''$ to $5\frac{5}{8}''$, diameter of the circular central portion constituted by a net-like structure 4 preferably approximately $1\frac{7}{8}''$, width of the circular surrounding flat imperforate strip 2 preferably between about $1\frac{3}{8}''$ to $1\frac{5}{8}''$, the area covered by rows of suction cups 6 on the lower face of the circular strip 2 extends from the outer circumference of the strip 2 inward up to the outer circumference of the flange preferably between about $\frac{3}{4}''$ to 1", diameter of suction cups 6 preferably approximately 5/16", diameter of hollow cylinder 21 approximately $1\frac{7}{8}''$, length of hollow cylinder 21 preferably approximately $1\frac{1}{2}''$. The aforementioned dimensions also apply to all the preferred embodiments of spikes 5, 10, 11 or bristles 12, 13, 14 or open web 15, or rough indented openings (not shown) provided only on the outer face of the net-like structure with a plurality of openings 4.

There is provided for this embodiment of the preferred circular shape 20 a reduced version having preferably a smaller outer circumference of the circular surrounding imperforate strip 2, adapted to the outer circumferences of the flange 18 to permit a secure installation of the base of the article over said flange. FIG. 15 illustrates the reduced version used on bathtubs of this preferred embodiment of the circular shape 20. This figure is also applicable to the reduced version of the embodiments shown in FIGS. 17 and 18. In this reduced version the lower face of the circular surrounding imperforate strip 2 provides one adhesive undersurface 7 or an optional plain self sealing undersurface (not shown). Since the base rests preferably over the flange 18 there is no undersurface with suction cups 6. The reduced version of the circular shape 20 in the embodiment shown in FIG. 14, as well as the reduced version of the other preferred embodiments of the circular shape 20 shown in FIGS. 17 and 18, is suitable to be used in bathtubs, shower stalls, lavatories, and the like.

There is given an example of dimensions of the reduced version of the circular shape 20 in the embodiment shown in FIG. 14 adapted to one exemplary drainpipe opening of bathtubs, and the like: diameter of the outer circumference of the circular flat surrounding imperforate strip 2, preferably approximately $3\frac{1}{8}''$, diameter of the circular central portion constituted by a net-like structure 4, preferably approximately $1\frac{7}{8}''$, width of the circular flat surrounding imperforate strip 2 preferably approximately $\frac{5}{8}''$, diameter of hollow cylinder 21 approximately $1\frac{7}{8}''$, length of hollow cylinder 21, approximately $1\frac{7}{8}''$.

Referring now to FIG. 17 there is shown a modification of the different parts of the preferred exemplary embodiment of the circular shape 20 of FIG. 14 and of another manner of assembling the different parts. In the peferred embodiment illustrated in this figure, the circular shape 20 comprises an upper portion with a circular mat-like shape constituted by a net-like structure with a plurality of openings 4, the upper face of which is provided entirely with the flexible spikes 5, 10, 11 or bristles 12, 13, 14, or with the previously described adherently bonded resilient open lofty web 15 of interengaged continuous crinkled unmodified or modified abrasive or foamed, large diamenter filaments. FIG. 17 illustrates a sample of spikes 5 with Burdock-like hooked tips. The circular mat-like shaped upper portion constituted by the net-like structure 4 is adherently bonded on its lower face along an area around its periphery, to the lower portion of the article constituted by a flexible circular flat thin imperforate base 22 having a circular central hole 23 defined therein of a size generally corresponding to that of the drainpipe opening, and the lower face of the base 22 providing several preferred undersurfaces, and adhesive undersurface 7 (see FIG. 15), or an undersurface provided preferably with three rows of suction cups 6 (see FIG. 16), or a plain self-sealing undersurface (not shown). The flexible circular flat imperforate base 22 further being integral with a flexible but rigid enough hollow cylinder 21 which is placed on the lower face of the circular flat imperforate base 22 along its inner circumference pointing downwards perpendicularly to the circular shape 20, in order to be inserted into the drainpipe openings. The circular mat-like shaped upper portion constituted by a net-like seructure with a plurality of openings 4 is adherently bonded to the lower portion of the article constituted by said flexible circular flat thin imperforate base 22 with a circular central hole 23 according with the treatment described in FIG. 12 for the embodiment of the circular shape 1. Said upper portion as suggested earlier could be produced for example by extrusion process and said lower portion by injection molding process. The insertable circular mat-like shape 20 in the preferred embodiment illustrated in this figure is preferably dimensioned in such a way as to cover entirely the drainpipe opening 24 with the circular central portion defined by the net-like structure 4 which extends over the circular central hole 23 of the circular flat thin imperforate base 22 and to cover entirely the flange 18 and to cover also a suitable distance over the surrounding area adjacent to the outer circumference of the flange 18 with the circular flat imperforate base 22 to permit a secure installation of the base of the article also over said area. This proportion is evident in the relationship of the different parts of the circular shape 20 to the drainpipe opening 24 and the flange 18, in this FIG. 17 and also in FIG. 18.

Therefore the circumferential dimension of the circular central hole 23 of the flexible circular flat imperforate base 22 should preferably be adapted to the circumferential dimensions of the drainpipe openings and the dimensions of the outer circumference of the flexible circular flat imperforate base 22 should preferably be such as to extend a suitable distance over the surrounding area adjacent to the outer circumference of the flange 18 to permit a secure installation of the base also over said area. Also the suction cups 6 are placed on the lower face of the circular flat imperforate base 22 over this area. On the other hand the adhesive 7 is coated over the entire lower face of the circular flat imperforate base 22. The description given on FIG. 14 concerning the adaptation of the dimensions of the hollow cylinder 21 to the drainpipe opening 24 is also applicable to this embodiment. There is given an example of dimensions of the circular shape 20 in the embodiment illustrated in this figure adapted to one exemplary drainpipe opening of bathtubs and the like: diameter of the circular upper portion constituted by net-like structure 4 preferably between about $4\frac{5}{8}''$ to $5\frac{1}{8}''$ diameter of the outer circumference of the circular flat imperforate base 22 preferably about $4\frac{5}{8}''$ to $5\frac{1}{8}''$. diameter of the inner circumference of the circular flat imperforate base 22 preferably approximately $1\frac{7}{8}''$, width of the circular flat imperforate base 22 preferably between about $1\frac{3}{8}''$ to $1\frac{5}{8}''$. The area covered by rows of suction cups 6, on the lower face of the circular base 22 extends from the outer circumference of said base 22 inward up to the outer circumference of the flange preferably between about $\frac{3}{4}''$ to 1", diameter of suction cups 6 preferably approximately 5/16" diameter of hollow cylinder 21: approximately $1\frac{7}{8}''$, length of hollow cylinder 21 preferably approximately $1\frac{1}{2}''$.

There is also provided for this embodiment of the preferred circular shape 20 a reduced version having preferably a smaller diameter of the circular mat-like shaped upper portion and of the outer circumference of the flexible circular flat imperforate base 22 adapted to the outer circumference of the flange 18 (this proportion is not illustrated), to permit a secure installation of the base of the article over said flange, and the base in this reduced version, as well as in the reduced version of the circular shape 20 in the embodiments illustrated in FIGS. 14 and 18, is flexible but has the necessary stiffness to stay firmly in place without warping or buckling. In the reduced version of the embodiment illustrated in this figure, the base 22 also provides one adhesive undersurface 7 or an optional plain self sealing undersurface (not shown). There is given an example of dimensions of the reduced version adapted to one exemplary drainpipe opening of bathtubs and the like: diameter of the circular mat-like shaped upper portion preferably approximately $3\frac{1}{8}''$, diameter of the inner circumference of the circular flat imperforate base 22 preferably approximately $1\frac{7}{8}''$, width of the circular flat imperforate base 22 preferably approximately $\frac{5}{8}''$; diameter of hollow cylinder 21 approximately $1\frac{7}{8}''$, length of hollow cylinder 21 preferably approximately $1\frac{1}{2}''$.

The adaptation of the dimensions of this embodiment to the drainpipe opening 18 and to the surrounding area, as well as to the examples of dimensions given for the bigger size of this embodiment and for its reduced version are applicable to the embodiment shown in FIG. 18.

Referring now to FIG. 18 there is shown a modification of the different parts of the preferred exemplary embodiment of the circular shape 20 of FIG. 14 and of another manner of assembling the different parts. In the preferred embodiment illustrated in this figure said circular shape 20 comprises an upper portion with a circular mat-like shape being configured by said resilient open lofty web 15. The description of the open web 15 as well as the treatment to adherently bond said open web 15 to the lower portion constituted by the flexible circular flat thin imperforate base 22 are the same as the ones described in FIG. 13 for the embodiment of the circular shape 1. Furthermore, the description given for the lower portions 22 and 21 of the embodiment of the circular shape 20 shown in FIG. 17 is applicable to the lower portions 22 and 21 of the embodiment shown in this FIG. 18, since both lower portions are the same, the only difference being the upper portion.

In like manner as stated in FIG. 17, the dimensions given therein are also applicable to the big size and to the reduced version of the embodiment shown in FIG. 18.

Figure 19:
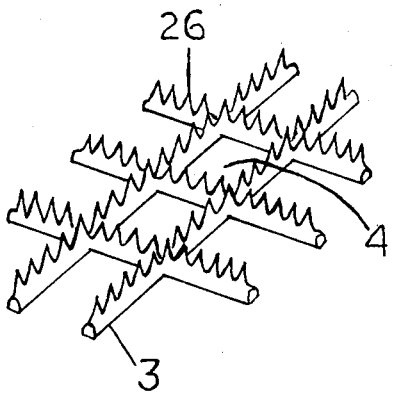
FIG. 19 is a perspective view in large scale of another preferred embodiment of the invention.

In another preferred exemplary embodiment (FIG. 19) the net-like structure with a plurality of openings 4 that constitutes the body of the article, in some of the preferred embodiments of the circular shapes 1 and 20, may have rough indented openings 26 and the rough indented edges of said openings protrude a suitable length and extend preferably perpendicularly to the net-like structure 4, so the upper face of the net-like structure 4 is provided with a surface similar to the surface of a grater, exerting a gripping action upon the fallen hair. Also any other feature, which could exert an entangling or gripping action upon the fallen hair, besides the ones described herein, may be employed.

Furthermore, the preferred circular shape 20 in the embodiment shown in FIG. 14, if desired, could also be made, only in its reduced version, of a more permanent material such as brass, stainless steel, bronze, copper or the like, by casting process or by any other equally suitable process, in which case the circular shape is provided, on its upper face, with flexible spikes or bristles of brass, stainless steel, bronze, copper or the like, or with a bonded flexible open lofty web of continuous irregularly coiled filaments of brass, stainless steel, bronze, copper or the like, being the diameter of the filaments between about 5 to 65 mils and preferably 10 to 35 mils. The metal web could be produced by extrusion and "knitting" processes, well known to those skilled in the art. Optionally, in this embodiment using a more permanent material, the upper face of the net-like structure with a plurality of openings 4, that constitutes the circular central portion of the circular shape 20 may have the aforementioned rough indented openings 26, FIG. 19, or the circular shape 20 may be provided with any other feature which could exert an entangling or gripping action. In this embodiment, the circular shape 20 comprises the previously described perforate and imperforate zones, and the dimensions are the same as the ones given for the reduced version of the circular shape 20 in the embodiment shown in FIG. 14.

From the aforegoing detailed description of the article, it will be apparent that numerous modifications can be made without affecting the concept of the invention.

No specific data were given herein in regard to the kind of adhesives, bonding resins and other substances that may be used in practising the invention, and also in regard to specific grades of materials which are best suited for the article of the present invention. It should be noted, however that these characteristics, materials and other details are well known to those skilled in the art, and no protection is sought for these expedients beyond the features explained hereinbefore and set forth in the claims.

The article of the present invention in its most preferred circular shapes 1 and 20, in order to prevent hair, hairpins or any other object carried away with the water flow during the taking of showers or washings or the like from entering and clogging the drainpipes of bathtubs, shower stalls, lavatories and the like, is to be installed in a preferred embodiment over the strainers and in another preferred embodiments over the drainpipe openings, with the insertable feature inserted into the drainpipe openings. The objective of preventing hair, hairpins, or any other object from entering and clogging the drainpipes, is then carried out through the entangling action exerted upon the fallen hair, hairpins or any other object carried away with the water flow by the flexible spikes 5, 10, 11, or bristles 12, 13, 14 or by the resilient open lofty integrated web 15 of interengaged continuous crinkled filaments; or by the rough indented openings of the net-like structure, which prevents the fallen hair, hairpins or any other object from entering and clogging the drainpipes of bathtubs, shower stalls, lavatories and the like. Said entangling action is reinforced by a blocking action exerted upon the fallen hair, hairpins or any other object, by the circular shape of the article in all its preferred embodiments which prevents the fallen hair, hairpins or any other objects from entering and clogging the drainpipes of bathtubs, shower stalls, lavatories and the like, by covering the entire circumference of its opening when installed over the strainers or over the drainpipe opening, while the large enough openings of the net-like structure 4 and/or of the open web 15 insure the free flow of running water without hair into the drainpipe. The circular flat imperforate base 2, 16 or 22 with several preferre dundersurfaces provides a secure installation of the article in all its preferred embodiments.

While preferred exemplary embodiments of the invention have been illustrated and described, although not by way of limitation, it will be obvious to those skilled in the art that various changes and modifications can be made without departing from the spirit and scope of the invention, and without sacrificing any of its advantages, and it is intended to cover in the appended claims all such changes and modifications that are within the scope of this invention.

I claim:

1. Stock material comprising a web with filamentary material extending upwardly from the surface of the web to constitute a pile, said web having a central portion of open meshlike construction for permitting substantially free flow of liquid therethrough and a defined edge portion laterally surrounding said central portion, said pile extending at least over the entirety of said central portion.

2. Stock material as defined in claim 1, wherein:

(a) said edge portion of said web comprises a base member for overlying a floor surface in immediately surrounding relation to a liquid egress opening in said surface, said base member having a central hole to overlie the egress opening;

(b) a three-dimensional mat is carried by the base member and comprises filamentary elements distributed throughout a volume extending horizontally at least over the entire area of the hole and vertically upwardly above the base member to a locality spaced above the base member for engaging and arresting liquid-carried debris outside and above the egress opening while permitting flow of liquid downwardly into the egress opening;

(c) some at least of the filamentary elements extend transversely across the hole and intersect with each other at a multiplicity of points distributed over the entire area of the hole so as to subdivide the hole into a multiplicity of individually openings for downward liquid flow into the egress opening, the transversely extending filamentary elements cooperatively constituting the web central portion; and (d) the filamentary elements include a multiplicity of flexible elements projecting upwardly throughout the entire vertical extent of said volume to constitute said pile and distributed at least over the entire area of the hole in adjacent relation to each other to constitute said pile.

3. Stock material as defined in claim 2, wherein said transversely extending filamentary elements are intersecting ribs cooperatively forming a netlike structure extending across said hole, and wherein said upwardly projecting filaments are connected to said netlike structure above said openings and extend upwardly therefrom.

4. Stock material as defined in claim 3, wherein said upwardly projecting filaments are flexible spikes which terminate in hook-shaped upper ends.

5. Stock material as defined in claim 3, wherein said upwardly projecting filaments are flexible spikes, at least some of which extend substantially perpendicular to said net-like structure.

6. Stock material as defined in claim 3, wherein said upwardly projecting filaments are flexible spikes, at least some of which extend oblique to said net-like structure.

7. Stock material as defined in claim 3, wherein said upwardly projecting filaments are flexible spikes, some of which extend substantially perpendicular to said net-like structure and the remainder of which extend oblique to said net-like structure.

8. Stock material as defined in claim 3, wherein said upwardly projecting filaments are bristles.

9. Stock material as defined in claim 8, wherein said bristles extend substantially perpendicular to said net-like structure.

10. Stock material as defined in claim 8, wherein some of said bristles extend substantially perpendicular to said net-like structure and the remainder of said bristles extend oblique to said net-like structure.

11. Stock material as defined in claim 2, wherein said upwardly projecting filaments form a three-dimensional web in which the upwardly projecting filaments cross each other.

12. Stock material as defined in claim 11, wherein said upwardly projecting filaments are bonded together where they cross each other.

13. Stock material as defined in claim 11 ,wherein said upwardly projecting filaments are unmodified filaments.

14. Stock material as defined in claim 11, wherein said upwardly projecting filaments are modified foamed filaments.

15. Stock material as defined in claim 11, wherein said upwardly projecting filaments are modified abrasive filaments.

16. Stock material as defined in claim 2, wherein said mat extends horizontally over said base member outwardly of said hole, and wherein said upwardly projecting filaments are distributed over said base member as well as over said hole.

17. Stock material as defined in claim 2, wherein said base member has an undersurface with hollow insertable means located along its inner perimeter to be inserted in the egress opening.

18. Stock material as defined in claim 2, wherein said base member has an undersurface with means connected therein to attach said web to the area around the egress opening.

19. Stock material as defined in claim 18, wherein said means is pressure sensitive adhesive with a removable release layer.

20. Stock material as defined in claim 18, wherein said means is a plurality of suction cups.

21. Stock material as defined in claim 2, wherein said transversely extending filamentary elements and said upwardly projecting filaments are formed integrally as a three-dimensional open filamentary web bonded to said base member and extending entirely over said hole.

22. Stock material as defined in claim 21, wherein said filamentary elements are unmodified filaments.

23. Stock material as defined in claim 21, wherein said filamentary elements are modified foamed filaments.

24. Stock material as defined in claim 21, wherein said filamentary elements are modified abrasive filaments.

25. Stock material as defined in claim 21, wherein said base member has an undersurface with hollow insertable means located along its inner perimeter to be inserted in the egress opening.

26. Stock material as defined in claim 21, wherein said base member has an undersurface with means connected therein to attach said web to the area around the egress opening.

27. Stock material as defined in claim 26, wherein said means is pressure sensitive adhesive with a removable release layer.

28. Stock material as defined in claim 26, wherein said means is a plurality of suction cups.

29. Stock material as defined in claim 2, wherein said upwardly projecting filaments are rough indented openings.

* * * * *